US005787631A

United States Patent [19]

Kendall

[11] Patent Number: 5,787,631

[45] Date of Patent: Aug. 4, 1998

[54] LASER BORE SIGHT

[75] Inventor: Lawrence Eldon Kendall, Auburn, Wash.

[73] Assignee: Acu-Sight, Inc., Auburn, Wash.

[21] Appl. No.: 762,405

[22] Filed: Dec. 9, 1996

[51] Int. Cl.[6] ..... F41G 1/34

[52] U.S. Cl. ..... 42/103

[58] Field of Search ..... 42/103; 33/234, 33/241, 286; 356/138, 153; 362/110

[56] References Cited

U.S. PATENT DOCUMENTS

| | | | |
|---|---|---|---|
| 3,782,832 | 1/1974 | Hacskaylo | 356/153 |
| 4,530,162 | 7/1985 | Forrest et al. | 33/234 X |
| 4,825,258 | 4/1989 | Whitson | 356/153 |
| 4,879,814 | 11/1989 | Wallace et al. | 33/234 |
| 5,001,836 | 3/1991 | Cameron et al. | 33/234 |
| 5,351,429 | 10/1994 | Ford | 42/103 |
| 5,365,669 | 11/1994 | Rustick et al. | 33/234 |
| 5,432,598 | 7/1995 | Szatkowski | 356/153 |
| 5,446,535 | 8/1995 | Williams | 356/153 |
| 5,454,168 | 10/1995 | Langner | 33/234 |
| 5,531,040 | 7/1996 | Moore | 42/103 |

*Primary Examiner*—Michael J. Carone
*Assistant Examiner*—Matthew J. Lattig
*Attorney, Agent, or Firm*—Mark Zovko

[57] ABSTRACT

A laser sighting apparatus for firearms having a laser module disposed in a cartridge-shaped housing with the same bore as the firearm. The laser module is adjustable so as to consistently produce a red dot on a target from a laser beam running through the bore of the firearm. The crosshairs of a conventional scope mounted on the firearm can be aligned with the red dot, and the laser module and housing removed from the firearm. A live round of ammunition, when discharged from the firearm, will now strike a target exactly at the point defined by the intersection of the crosshairs of the firearm's scope. A safety spring is provided which prevents destruction of the aperture if the firearm is accidently discharged with the laser module and housing still in the bore of the firearm.

13 Claims, 2 Drawing Sheets

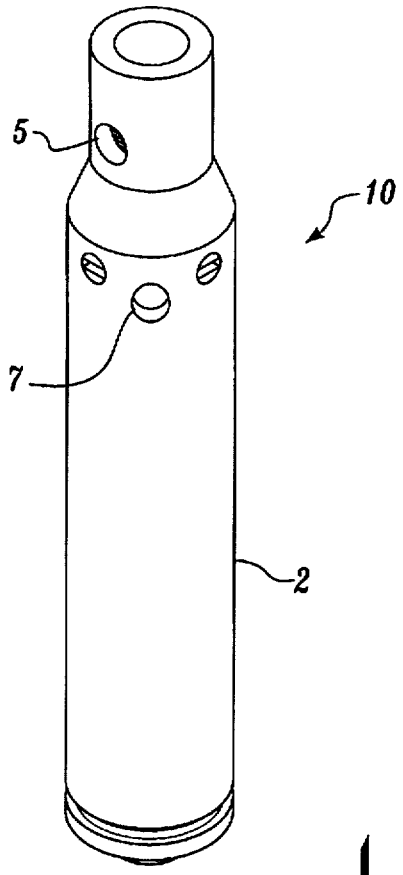
Fig. 1
Fig. 2
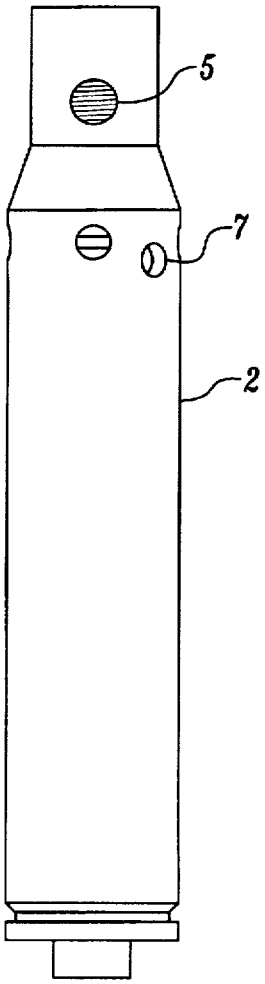
Fig. 3
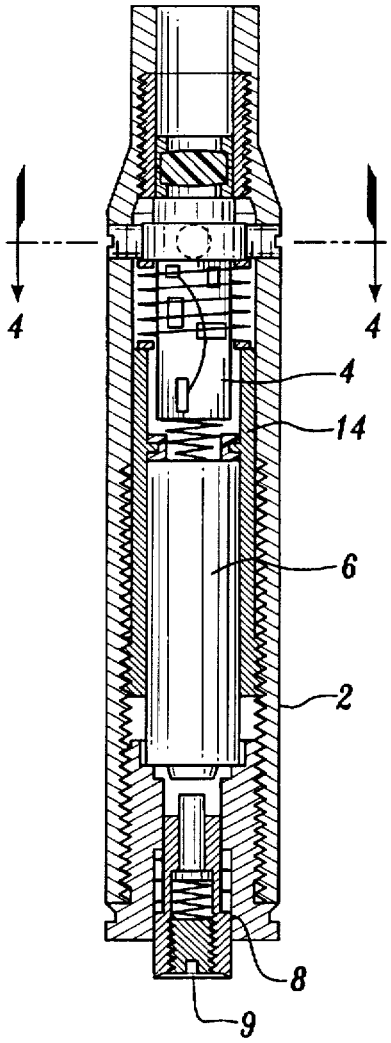
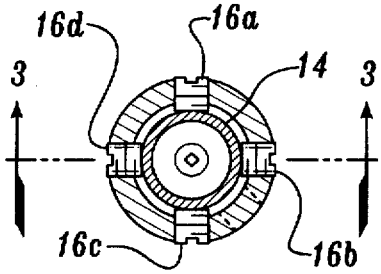
Fig. 4

LASER BORE SIGHT

BACKGROUND OF THE INVENTION

1. Field of the Invention

This invention relates in general to accurate sightings of targets when using rifles or pistols, and more particularly to an in-bore laser sighting system which improves the accuracy of a firearm.

2. Description of the Prior Art

It is well known to provide sights for aiming rifles or pistols. High powered scopes are considered indispensable for accuracy of a rifle at most ranges. The scope is mounted on the top of the rifle or pistol and provide a magnified view of the potential target when sighted. Cross hairs within the scope are used to sight the target with the intersection of the cross hairs placed exactly on the intended target. Limitations of the high powered scope include the problem that the scope must be "calibrated" to assure accuracy. Typically, adjusting screws are provided which can be used to adjust the scope so that in fact the cross hairs are accurately marking the target. If a rifle, for example, was mounted on a stand and the target sighted in the cross hairs of the scope on top of the rifle barrel, minor adjustments of the scope may be needed to assure accuracy. A rifle user may fire a round of ammunition in this situation, noting where the round strikes with respect to the target. Adjustment of the scope can then be made to align the cross hairs of the scope with the actual point at which the round of ammunition struck the target. It may take several iterations of this "trial and error" firing the rifle and adjusting the scope to bring the cross hairs in line with the actual striking point of the ammunition round. As can be expected, this procedure, even when performed by skilled marksmen, is cumbersome and inherently less than precise.

Attempts have been made to use lasers in the sighting process. Applicant is aware of lasers or laser modules being mounted to the top of the rifle barrel and used to sight a target. This method, although apparently an improvement, has inherent inaccuracy as ultimately the laser dot used in sighting is an extrapolation. The laser does not follow the exact path of the round of ammunition, but is used to approximate the expected trajectory of the ammunition round. The inventor of the present invention is also aware that attempts have been made to mount laser modules in the end of the rifle barrel. Inaccuracy, however, is the rule as the placement of the laser module in the end of the rifle barrel does not insure eventual proper alignment of the laser dot with the target as the end of the rifle barrel may have imperfections or wear which leads to error.

A preliminary search of the prior art performed for the present applicant found the following U.S. Patents of possible interest: U.S. Pat. Nos. 3,782,832; 4,530,162; 4,825,258; 4,879,814; 5,365,669; and 5,454,168.

Of this array, the patent of most interest was U.S. Pat. No. 5,365,669 issued to Rustick et al. The present invention has additional features which address problems unforeseen by Rustick et al. The laser module of Rustick is disposed within a housing 14. A problem exists in that the laser beam emitting from the laser module is likely not to clear the bore of the rifle unless suitable alignment is provided by the present invention occurs. In other words, the laser module 26 is disposed in the housing 14 with a given amount of tolerance. Unless the module is aligned within that housing to provide a laser beam which in fact clears the bore of the firearm, the laser beam emitted will strike the bore of the firearm and not show a "dot" on the target. In Rustick's apparatus, only by random chance will the laser beam clear the firearm bore and show as a dot on the target as the margin of error in the apparatus is relatively small. In the present invention, the laser module can be aligned within its housing to obviate the aforementioned problems and provide an apparatus functional in practice as well as theory. The present invention also provides a safeguard against destroying the apparatus by accidentally pulling the trigger of the firearm while the device is within the bore of the firearm. The present invention provides a spring which can absorb the shock on the apparatus from a striking fire pin caused by accidentally pulling the trigger of the firearm.

SUMMARY OF THE INVENTION

The present invention includes apparatus and a method for accurately sighting a target when using a firearm having a bore, a bolt having a firing pin, and a scope mounted on the barrel of the firearm. The laser is placed within the bore of the firearm and can be activated by engaging the bolt of the firearm as if a round of ammunition was placed within the bore of the firearm. The "laser" is a laser module disposed in a cartridge or housing having the same bore as the firearm. The cartridge containing the laser module also has a battery immediately behind the laser module for energizing the laser module. A spring type switch is also placed in the cartridge to the rear of the battery. The spring switch allows the laser module to remain in the off position until the switch is pressed (by the bolt of the firearm when engaged), causing a laser beam to be emitted from the laser module. After suitable alignment of the laser module, the laser beam will appear as a dot of light upon a given target sighted through the bore of the firearm.

It has been found that a nine volt battery produces a visible dot on the target at the range of conventional rifles or pistols. In practice the cartridge containing the laser module is placed within the bore of the firearm. When the bolt is engaged, the spring switch causes the laser module after suitable alignment to emit a laser beam which will appear as a dot when aimed at a target. The firearm will have an adjustable sight, preferably a scope mounted on the rifle barrel. The cross hairs of the scope are then aligned with the laser dot appearing on the target. Usually, this alignment procedure will require slight adjustment of the scope using the adjusting screws of the scope until the cross hairs of the scope and the laser dot emanating from the bore of the rifle are aligned. At this point, even at long distances, it is assured that the cross hairs of the scope are aligned with the exact position that a round of ammunition will strike when subsequently discharged from the firearm. After the scope or sight of the firearm has been calibrated using the above outlined procedure, the cartridge containing the laser module is removed from the bore and replaced with a live round of ammunition. The firearm is then aimed using the cross hairs of the scope and the round of ammunition will accurately strike the exact point located by the cross hairs of the scope.

The preferred embodiment of the invention includes an inner sleeve disposed within the cartridge or housing of the apparatus. The inner sleeve is threading into the housing and the laser module and battery are fitted in the inner sleeve. The laser module within the inner sleeve can be aligned in a direction transverse to the rifle bore by set screws which fit through the housing, so that the beam clears the bore of the firearm and in fact places a laser "dot" on an outside target. Also, in a preferred embodiment of the invention, the spring switch actually has two springs which operate. The first spring when depressed by the bolt of the firearm will activate the laser module by allowing contact of the switch and the battery. The second spring is used to provide a "cushion", reacting against the firing pin of the firearm in case of the accidental discharge of the firearm when the sighting apparatus was still in the bore of the firearm.

Rather than the apparatus being destroyed by the discharge of the firearm when the apparatus is in the bore of the firearm, the second spring absorbs the blow from the firing pin without damaging the sighting apparatus.

The through-the-bore laser sighting disclosed in this invention is especially adapted to be used in any rifles or pistols used in hunting but can be readily adapted for use in any caliber weapon.

It is therefore an object of the present invention to provide an accurate sighting system for sighting a firearm to a target.

Another object of the present invention is to provide a laser bore sight which improves the accuracy in sighting a firearm.

Yet another object of the present invention is to provide accurate sighting of a firearm within the range of the firearm.

Still another object of the present invention is to eliminate error inherent in conventional sighting systems mounted on the barrel of a firearm.

These and other objects and advantages of the present invention will become more apparent from the following detailed description of the invention when taken in conjunction with the drawings submitted herein.

BRIEF DESCRIPTION OF THE DRAWINGS

FIG. 1 is a pictoral of a laser cartridge of the present invention.

FIG. 2 is a side view of a laser cartridge of the present invention.

FIG. 3 is a cross sectional view of the present invention taken along line 3—3 of FIG. 4.

FIG. 4 is a cross sectional view of a cartridge in accordance with the present invention taken along line 4—4 of FIG. 3.

DESCRIPTION OF THE PREFERRED EMBODIMENT

Figure 5:
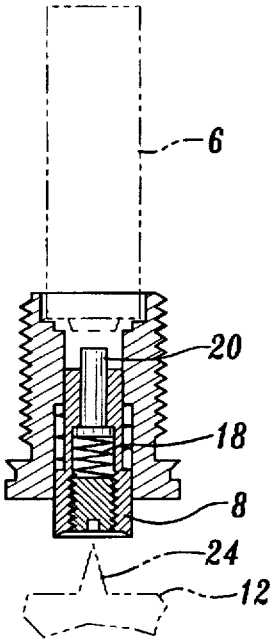
FIG. 5 is a cross sectional view of a cartridge in accordance with the present invention.

Referring to the Figures especially 1 through 3, a special laser containing cartridge generally designated as 10 is provided, having a housing 2 in the shape of a regular shell casing e.g. 30/06 shell which can fit in the bore of a 30/06 rifle. The housing 2 has a laser module 4 in its fore end and a special nine volt battery 6 to the rear of the module 4 located in the middle of the housing. A spring loaded off/on switch 8 is provided at the rear end of the housing 2. The switch 8 has a small indentation 9 on its end which is adapted to be contacted by the end of the rifle's bolt. Vent holes 5 and 7 are provided which prevent harmful heat build-up when the laser is activated.

The laser module 4 is an "off the shelf" item and is partially disposed within an inner sleeve 14 threaded into housing 2. The laser module 4 can be adjusted by set screws 16*a, b, c,* and *d* within the sleeve 14 so that the laser beam emanating from module 4 will not strike the sides of the rifle bore when the module 4 is activated by switch 8. This feature is critical as an unadjustable laser module 4 will emit a laser beam and only by random chance will the beam exit the rifle barrel. If the laser beam strikes the side of the rifle bore it is rendered useless for sighting. The present system using the sleeve 14 and set screws 16*a, b, c, d,* allows a snug yet adjustable fit of the laser module 4 within its housing 2. If the beam from the laser module is striking the sides of the rifle bore, appropriate adjustment of screws 16*a, b, c, d* can be made to allow the beam to properly exit the bore of the rifle barrel.

Figure 6:
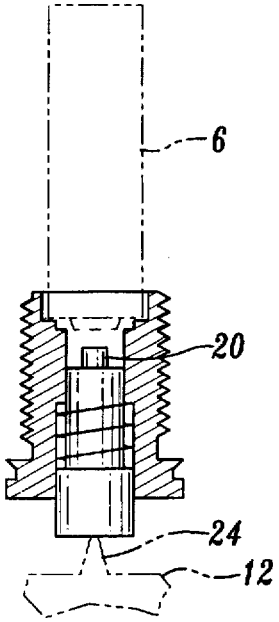
FIG. 6 is another partial cross sectional view of a cartridge in accordance with the present invention showing a firing pin contacting the cartridge.
Figure 7:
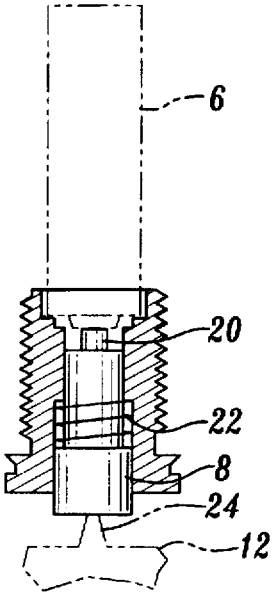
FIG. 7 is another partial cross sectional view of the present invention showing a secondary spring resisting the firing pin and preventing destruction of the apparatus if accidental firing occurs when the cartridge is in the barrel.
Figure 8:
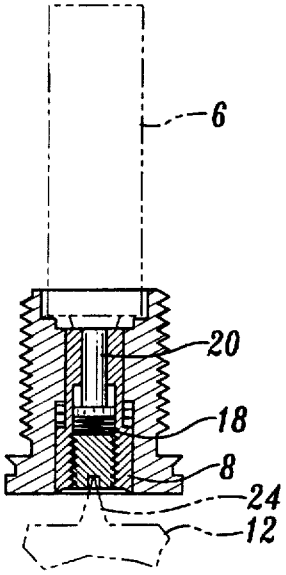
FIG. 8 is yet another partial cross sectional view of the present invention showing the firing pin causing the switch to activate the laser module.

The switch 8 has an indentation 9 on its end which is contacted by the rifle bolt 12 when the apparatus is being used (see FIGS. 5, 6, and 7). When spring 18 is compressed by the action of the rifle bolt, pin 20 touches the battery and activates the laser module 4 (see FIG. 7). If accidental firing of the rifle occurs, the force of the firing pin 24 will be absorbed by secondary spring 22 (see FIGS. 7, 8). This secondary spring 22, therefore, prevents accidental destruction of the apparatus if the trigger of the rifle or firearm is pulled when the apparatus is within the rifle bore.

In practice, the laser containing cartridge is placed in a bore of a rifle as any live round of ammunition would be. When the bolt is engaged it contacts the button 9 on switch 8 which causes the laser module 4 to emit a beam of light. Assuming proper adjustment of set screws 16*a, b, c, d,* the beam of light will appear as a red dot on a given target as the rifle is sighted by the user. The user will then adjust the cross hairs of the scope of the rifle using the scope adjusting screws to exactly line up with the laser dot from laser module 4. As the laser dot is emanating from within the bore of the rifle in the exact path of the live round, total accuracy of the sighting is achieved. After the scope of the rifle is adjusted to the laser dot exactly, the laser containing cartridge is removed from the barrel of the rifle and a live cartridge is placed therein. The user now knows that the round of ammunition will strike the target exactly where the crosshairs of the scope indicate. The apparatus can also be used with a conventional adjustable sight which is not a scope. Accurate marksmanship can be expected at long ranges (150–200 yds.).

The invention may be embodied in other forms without departing from the spirit or essential characteristics thereof. The present embodiments are therefore to be considered in all respects as illustrative and not restrictive, the scope of the invention being indicated by the appended claims rather than the foregoing description, and all change which comes within the meaning and range of equivalency of claims is intended to be embraced therein.

I claim:

1. A method for accurately sighting a target when using a firearm having a bore, a bolt with a firing pin positioned thereon and sighting means which includes, a. Placing laser means within the bore of the rifle;

b. Activating said laser means whereby said laser means by manually adjustable means emits a laser beam c. Aligning said laser means whereby a laser beam from said laser means runs through the bore of the firearm and falls on the target making a visible spot thereon, d. Calibrating of the firearm so that the sighting is fixed on the visible spot from the laser beam showing on the target;

e. Removing the laser means from the bore of the rifle, and replacing said laser means with a live round of ammunition.

2. The method of claim 1 wherein said laser means includes a laser module, energizing means, and switch means.

3. The method of claim 2 wherein said switch means of said laser means is activated by engaging the bolt of the firearm.

4. The method of claims 2 wherein said energizing means is a nine volt battery.

5. The method of claim 1 wherein said laser means is at least partially contained within an inner sleeve of a housing, said housing having the configuration of an empty cartridge of the same bore as the firearm.

6. The method of claim 5 wherein said switch means has first spring means which when depressed by the bolt of the firearm activates said laser means, and second spring means which reacts against the firing pin of the firearm if discharge of the firearm occurs when said housing containing said laser means is in the bore of the firearm.

7. Apparatus for accurately sighting a target when using a firearm having a bore, a bolt with a firing pin positioned thereon and sighting means which comprises a laser module at least partially disposed in an inner sleeve of a housing fitted within the bore of the firearm, said housing having alignment means for aligning said laser module manually within said housing whereby said laser module emits a laser beam through the bore of the firearm adapted to fall on a given target point.

8. The apparatus of claim 7 which includes energizing means for said laser module and switch means for controlling said laser module disposed within said inner sleeve of said housing.

9. The apparatus of claim 8 wherein said switch means is activated by engaging the bolt of the firearm.

10. The apparatus of claim 9 wherein said switch means has first spring means which when depressed by the bolt of the firearm activates said laser module and second spring means contacting said switch means which reacts against the force of the firing pin on said switch means if discharge of the firearm occurs when said housing containing said laser module is in the bore of the firearm.

11. The apparatus of claim 8 wherein said energizing means is a nine volt battery.

12. The apparatus of claim 7 wherein said housing has the configuration of an empty cartridge of the same bore as the firearm.

13. Apparatus for accurately sighting a target when using a firearm having a bore, a bolt with a firing pin positioned thereon and sighting means which comprises a laser module at least partially disposed in an inner sleeve of a housing fitted within the bore of the firearm, said laser module disposed within said housing and manually adjustable, whereby said laser module emits a laser beam through the bore of the firearm adapted to fall on a given target point, and switch means for controlling said laser module, said switch means having first spring means which when depressed by the bolt of the firearm activates said laser module, and second spring means contacting said switch means which reacts against the force of the firing pin on said switch means if discharge of the firearm occurs when said housing containing said laser module is in the bore of the firearm.

* * * * *